US011145445B2

(12) United States Patent
Turgut

(10) Patent No.: US 11,145,445 B2
(45) Date of Patent: Oct. 12, 2021

(54) BULK ANISOTROPIC EXCHANGE-SPRING MAGNETS AND METHOD OF PRODUCING THE SAME

(71) Applicant: Government of the United States as Represented by the Secretary of the Air Force, Wright-Patterson AFB, OH (US)

(72) Inventor: Zafer Turgut, Dayton, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 419 days.

(21) Appl. No.: 15/791,875

(22) Filed: Oct. 24, 2017

(65) Prior Publication Data

US 2018/0166189 A1 Jun. 14, 2018

Related U.S. Application Data

(60) Provisional application No. 62/434,062, filed on Dec. 14, 2016.

(51) Int. Cl.
*H01F 1/059* (2006.01)
*B22F 9/04* (2006.01)
(Continued)

(52) U.S. Cl.
CPC ..... *H01F 1/059* (2013.01); *B22F 3/14* (2013.01); *B22F 3/24* (2013.01); *B22F 9/04* (2013.01); *B22F 9/082* (2013.01); *C22C 38/00* (2013.01); *C22C 38/002* (2013.01); *C22C 38/005* (2013.01); *H01F 1/0579* (2013.01); *B22F 2003/248* (2013.01); *B22F 2301/355* (2013.01); *B22F 2998/10* (2013.01); *C22C 1/0433* (2013.01); *C22C 33/0278* (2013.01); *C22C 2202/02* (2013.01)

(58) Field of Classification Search
None
See application file for complete search history.

(56) References Cited

U.S. PATENT DOCUMENTS 4,792,367 A 12/1988 Lee
5,211,766 A * 5/1993 Panchanathan ..... H01F 1/0576 148/101

(Continued)

FOREIGN PATENT DOCUMENTS

WO WO-2015051986 A1 * 4/2015 ..... B22F 1/0018

OTHER PUBLICATIONS

Chen (Journal of Rare Earths, 2010, vol. 28, No. 2, p. 277-281). (Year: 2010).*

(Continued)

*Primary Examiner* — Xiaowei Su
(74) *Attorney, Agent, or Firm* — AFMCLO/JAZ; Chastity D.S. Whitaker

(57) ABSTRACT

A method of preparing a permanent magnet nanocomposite. The method includes melting a precursor alloy having a hard magnetic phase and a magnetically soft phase. The hard magnetic phase has less than a stoichiometric amount of rare earth metal or noble metal. The melted precursor is cast into flakes and milled into a powder. The powder may then be pressure crystalized.

21 Claims, 14 Drawing Sheets

(51) Int. Cl.

| | |
|---|---|
| ***B22F 3/14*** | (2006.01) |
| ***B22F 3/24*** | (2006.01) |
| ***C22C 38/00*** | (2006.01) |
| ***B22F 9/08*** | (2006.01) |
| ***H01F 1/057*** | (2006.01) |
| *C22C 1/04* | (2006.01) |
| *C22C 33/02* | (2006.01) |

(56) References Cited

U.S. PATENT DOCUMENTS

| | | | | |
|---|---|---|---|---|
| 9,129,731 | B2 | 9/2015 | Komuro et al. | |
| 9,242,295 | B2 | 1/2016 | Liu | |
| 2004/0025974 | A1* | 2/2004 | Lee | B82Y 25/00 148/301 |
| 2008/0199715 | A1 | 8/2008 | Shimada et al. | |
| 2012/0021221 | A1* | 1/2012 | Miyoshi | B82Y 25/00 428/402 |
| 2016/0163449 | A1 | 6/2016 | Mccall et al. | |
| 2018/0166189 | A1 | 6/2018 | Turgut | |
| 2018/0166190 | A1* | 6/2018 | Turgut | B22F 3/14 |

OTHER PUBLICATIONS

Rong (Journal of Applied Physics, 2012, vol. 111, No. 07A717). (Year: 2012).*

Machine translation of WO2015/051986A1. (Year: 2015).*

Turgut, Materials for Extreme Environments, (Year: May 18-22, 2015).*

R. Coehoorn et al., "Melt spun permanent magnetic materials containing Fe3B as the main phase," J. Magn. Magn. Mater., vol. 80 (1989) 101-104.

E. F. Kneller et al., "The exchange-spring magnet: a new material principle for permanent magnets," IEEE Trans. Magn., vol. 27 (1991) 3588-3600.

R. Skroski et al., "Giant energy product in nanostructured two-phase magnets," Phys. Rev. B, vol. 48, (1993) 15812-15816.

M. Sagawa et al., "Permanent magnet materials based on the rare earth-iron-boron tetragonal compounds," IEEE Trans. Magn., vol. 20 (1984) 1584-1589.

R. K. Mishra, "Crystallographic and magnetic alignment in die-upset Nd—Fe—B Magnets," J. Mater. Eng., vol. 11, (1989) 87-93.

K. H. J. Buschow et al, "Metastable ferromagnetic materials for permanent magnets," Less-Common Metals, vol. 145 (1989) 601-611.

J. Ding et al., "Remanence enhancement in mechanically alloyed isotropic Sm7Fe93-nitride," J. Magn. Magn. Mater., vol. 124 (1993) 1-4.

T. Kobayashi et al., "Mössbauer study on intergranular phases in the bcc-Fe/Nd—Fe—B nanocomposite alloys," J. Appl. Phys., vol. 87 (2000) 6579-6581.

D. Lee et al., "Bulk isotropic and anisotropic nanocomposites Rare-Earth magnets," IEEE Trans. Magn., vol. 40 (2004) 2904-2906.

S. Liu et al., "Enhancing magnetic properties of bulk anisotropic Nd—Fe—B/β-Fe composite magnets by applying powder coating technologies," IEEE Trans. Magn., vol. 42 (2006) 2912-2914.

Y. Liu et al., "Development of crystal texture in Nd-lean amorphous Nd9Fe85B6 under hot deformation," Appl. Phys. Lett., vol. 94 (2009) 172502 1-3.

A. Inoue et al., "Hard magnetic properties of Nd—Fe—B alloys containing intergranular amorphous phase," IEEE Trans. Magn., vol. 31 (1995) 3626-3628.

Y. Q. Wu et al., "Microstructural characterization of an α-Fe/Nd2Fe14B1 nanocomposite with a remaining amorphous phase," J. Appl. Phys., vol. 87 (2000) 8658-8665.

E. E. Fullerton et al., "Exchange-spring behavior in epitaxial hard/soft magnetic bilayers," Phys. Rev. B, vol. 58 (1998) 12193-12200.

W. Liu et al., "Structure and magnetic properties of sputtered (Nd,Dy) (Fe,Co,Nb,B)5.5/M M=FeCo,Co multilayer magnets," J. Appl. Phys., vol. 91 (2002) 7890-7892.

X. Rui et al., "High-energy product exchange-spring FePt/Fe cluster nanocomposite permanent magnets," J. Magn. Magn. Mater., vol. 305 (2006) 76-82.

N. M. Lam et al., "Fabrication of Nd—Fe—B exchange-spring magnets," J. Phys.: Conf. Series, vol. 187 (2009) 012076 (6 pages total).

United States Patent and Trademark Office, Non-Final Office Action in U.S. Appl. No. 15/791,921, dated Feb. 19, 2020, 11 pages total.

Z. Chen et al., "Effect of yttrium substitution on magnetic properties and microstructure of Nd—Y—Fe—B nanocomposite magnets," J. Rare Earths, vol. 28 (2010) 277-281.

Wecker et al., "Coercivity after heat treatment of overquenched and optimally quenched Nd—Fe—B," J. Appl. Phys., Mol. 62 (1987) 990-993.

Mishra et al., "The development of the microstructure of die-upset Nd—Fe—B magnets," J. Magnetism Magnetic Mater., vol. 84 (1990) 88-94.

United States Patent and Trademark Office, Final Office Action in U.S. Appl. No. 15/791,921, dated Sep. 17, 2020, 16 pages total.

Turgut et al., "Anisotropic alpha-Fe/Nd—Fe—B exchange-spring magnets produced by high pressure crystallization," IEEE Trans Magnetics, vol. 52 (2016) 1-4.

* cited by examiner

BULK ANISOTROPIC EXCHANGE-SPRING MAGNETS AND METHOD OF PRODUCING THE SAME

Pursuant to 37 C.F.R. § 1.78(a)(4), this application claims the benefit of and priority to prior filed Provisional Application Ser. No. 62/434,062, filed Dec. 14, 2016, which is expressly incorporated herein by reference in its entirety.

RIGHTS OF THE GOVERNMENT

The invention described herein may be manufactured and used by or for the Government of the United States for all governmental purposes without the payment of any royalty.

FIELD OF THE INVENTION

The present invention relates generally to permanent magnets and, more particularly, to bulk permanent magnet composition and methods of making the same.

BACKGROUND OF THE INVENTION

Green and renewable energy technologies have increased the demand for high-energy permanent magnets ("PMs"). PM materials are evaluated on coercive force ($H_c$; the measure of a material's resistance to magnetization reversal), energy product ($BH_{max}$; (measure of the energy that can be delivered by the PM), and an exchange that determines a Currie Temperature, $T_c$, of the material, wherein these values are maximized in an ideal, PM nanocomposite.

PM nanocomposites are generally comprised of a hard magnetic phase and a magnetically soft phase, which benefit from the spring-exchange effect whereby a high saturation magnetization of the magnetically soft phase and a large coercivity of the hard magnetic phase results (see FIGS. 1A-2). A suitably dispersed hard magnetic phase provides high enough nucleation fields for magnetization reversal and a soft magnetic phase having a highest possible saturation magnetization ($B_s$) provides a high average magnetization. Yet, fundamental engineering difficulties associated with the development of such magnets exist. For example, to obtain large $H_c$ values, a strong uniaxial magnetocrystalline anisotropy ($K_u$) is required (that is, the hard magnetic phase should be aligned); however, high $BH_{max}$ values are conventionally achieved in alloy systems having large anisotropies. Remanent inductions ($B_r$) and strong exchange are conventionally only found in the alloys of rare earth elements and transition metals of iron and cobalt, which means PM nanocomposites have largely been limited to rare earth elements and transition metals. And, the composition of PM nanocomposites should comprise evenly intermixed combination of the hard magnetic phase and magnetically soft phase so that the exchange-spring effect occurs and without undesirable phases present.

A long standing goal in the state of this art has been to develop a PMs comprising (1) less rare earth content, (2) a hard magnetic phase of the permanent magnet exhibits crystalline alignment, (3) the hard magnetic phase also being magnetostatically coupled to a magnetically soft phase, (4) with permanent magnet comprising at least 50 vol. % of the magnetically soft phase, (5) wherein the hard magnetic phase and the magnetically soft phase are uniformly distributed (nanometer scale) within the permanent magnet, and (6) wherein the coupling between the hard magnetic phase and the magnetically soft phase is complete such that a single phase behavior is observed (i.e., no shoulder is observed on a demagnetization curve). Such a nanocomposite takes advantage of a high magnetocrystalline anisotropy of the hard magnetic phase and high saturation magnetization of the magnetically soft phase.

Conventionally, four systems used to manufacture PMs: (1) $SmCo_5$ ($Sm_2Co_{17}$), (2) $Nd_2Fe_{14}B$, (3) $PrCo_5$, and (4) $Pr_2Fe_{14}B$. Of these, two ($Nd_2Fe_{14}B$ and $SmCo_5$) are of commercial significance. So, while $PrCo_5$ has a theoretical $BH_{max}$ that is greater than the $BH_{max}$ of $SmCo_5$, impurity phases ($Pr_2Co_7$, $Pr_5Co_{15}$, $Pr_2Co_{17}$) in the $PrCo_5$ system are much softer magnetically than the $SmCo_5$ system, resulting in lower coercivity values. For $Pr_2Fe_{14}B$ systems, these PMs offer magnetic properties that are comparable to the magnetic properties of $Nd_2Fe_{14}B$; however, praseodymium is not as abundant as neodymium. As such, praseodymium-based systems have never gained commercial significance. Use of Sm—Co-based PM systems are mainly confined to high temperature applications. And finally, the main route by which Nd—Fe—B-based PMs are manufactured is via powder metallurgy techniques, which include micrometer size powder synthesis, alignment of green compacts, sintering, and thermal treatments. A less common manufacturing technique utilizes hot compaction followed by hot deformation (die upsetting) of overquenched melt spun flakes. This alternative approach offers finer grain size and higher coercivities, but the attainable degree of alignment is limited and non-uniform when compared to PMs manufactured by powder metallurgy.

More recently, a third technique for realization of appreciable coercivity values and full intergranular coupling in two-phase Nd—Fe—B+$Fe_3B$ (i.e., α-Fe) PMs included annealing of overquenched melt spun precursors. This newer methodology has led to the development of exchange-spring theory. However, despite this more recent development, difficulties in the alignment of $Nd_2Fe_{14}B$ grains in length scales comparable to the exchange-length of $Nd_2Fe_{14}B$ remain.

Theory predicts that when a grain of soft magnetic phase having a size, $D_g$, that is on the order of twice a size of the Bloch-Wall width of a corresponding hard magnetic phase, $\delta_w$, the nucleation field reaches the anisotropy field of the magnetic hard phase. The average grain size may be estimated using exchange stiffness, A, and anisotropy, K, constants. Alternatively, average grain size may be estimated using exchange integral, J, magnitude of the spin, S, and anisotropy and lattice constants, K and a, respectively:

$$D_g \cong 2\delta_w = 2\pi\left(\frac{JS^2}{Ka}\right)^{1/2} = 2\pi\left(\frac{A}{K}\right)^{1/2} \quad \text{Equation 1}$$

As alluded to above, the use of rare earth metals as the hard magnetic phase has been essential in modern technologies, such as electric motors, electric generators, actuators, hard disk drives, travelling wave tubes, missile guidance systems, and communication systems. Concerns over the supply chain of rare earths coupled with the projected increase in demand for clean energy technologies are expected to cause a considerable rise in rare earth prices and to further limit availability. At present, about 20% of the total annual rare earth production is consumed in the form of PM, wherein typical PM motors and or generators for a hybrid electric vehicle may requires approximately 1.5 kg and 1.0 kg of sintered $Nd_2Fe_{14}B$, respectively. Electric power steering ("EPS") in such vehicles increases that requirement by about 100 g of $Nd_2Fe_{14}B$ use per vehicle. In other examples, PMs in household air conditioner compressors uses 100 g to 200 g of $Nd_2Fe_{14}B$ use per unit, wind turbines use about 100 kg of sintered $Nd_2Fe_{14}B$ magnet per megawatt of power generation.

It is for at least these reasons that there remains a need of improved PM nanocomposites having minimal rare earth compositions that maintain or improve other characteristics of the conventional PMs.

SUMMARY OF THE INVENTION

The present invention overcomes the foregoing problems and other shortcomings, drawbacks, and challenges of bulk permanent magnetic nanocomposites having a low rare earth metal compositions. While the invention will be described in connection with certain embodiments, it will be understood that the invention is not limited to these embodiments. To the contrary, this invention includes all alternatives, modifications, and equivalents as may be included within the spirit and scope of the present invention.

According to embodiments of the present invention, a method of preparing a permanent magnet nanocomposite includes melting a precursor alloy having a hard magnetic phase and a magnetically soft phase. The hard magnetic phase has less than a stoichiometric amount of rare earth metal or noble metal. The melted precursor is cast into flakes and milled into a powder. The powder may then be pressure crystalized.

In some aspects of the present invention, pressure crystallizing the powder may include pressurizing and heating the powder for a pressurization time. The powder is held at a crystallization temperature and pressure for a hold time to promote crystal growth. Crystal growth may then be rapidly quenched.

In still other embodiments of the present invention, a method of preparing a permanent magnet nanocomposite includes melting a precursor alloy having a hard magnetic phase and a magnetically soft phase. The hard magnetic phase has less than a stoichiometric amount of rare earth metal or noble metal. The melted precursor is cast into flakes and milled into a powder. The powder may then be pressure crystalized by pressurizing and heating the powder for a pressurization time. The powder is held at a crystallization temperature and pressure for a hold time to promote crystal growth. Crystal growth may then be rapidly quenched.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Figure 1A:
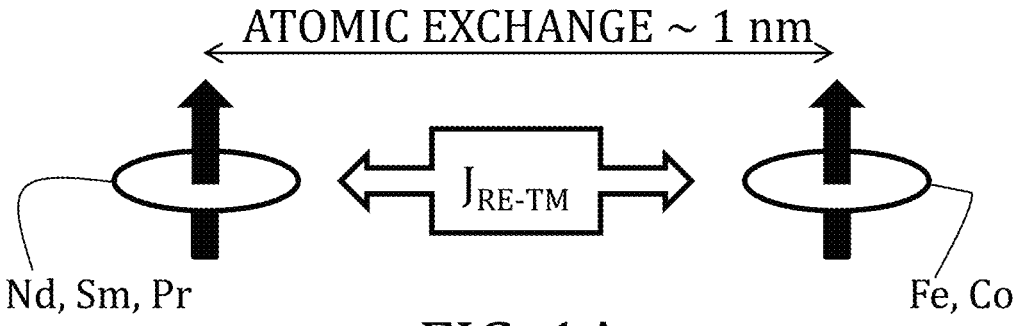
FIGS. 1A and 1B are schematic representations of atomic and intergranular exchange in permanent magnet nanocomposites having both rare earth and transition metals.
Figure 1B:
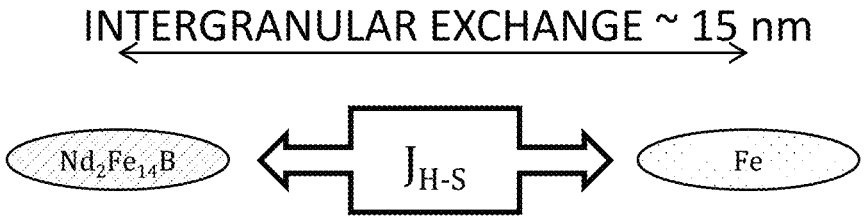
Figure 2:
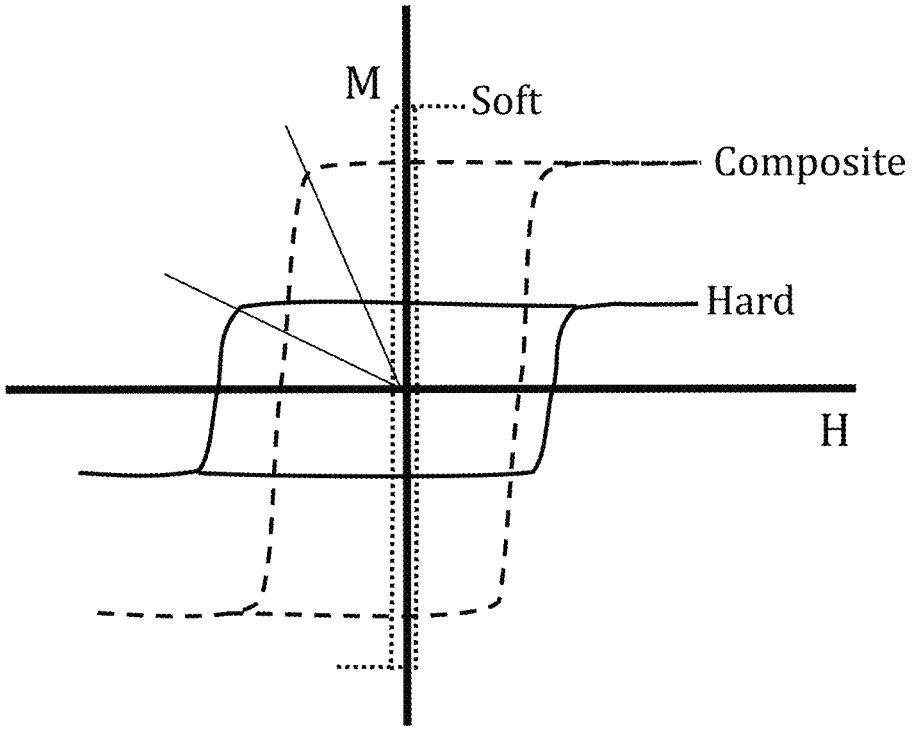
FIG. 2 is a graphical representation of a magnetic hysteresis loops for soft magnetic materials, hard magnetic materials, and composite magnetic materials.
Figure 3:
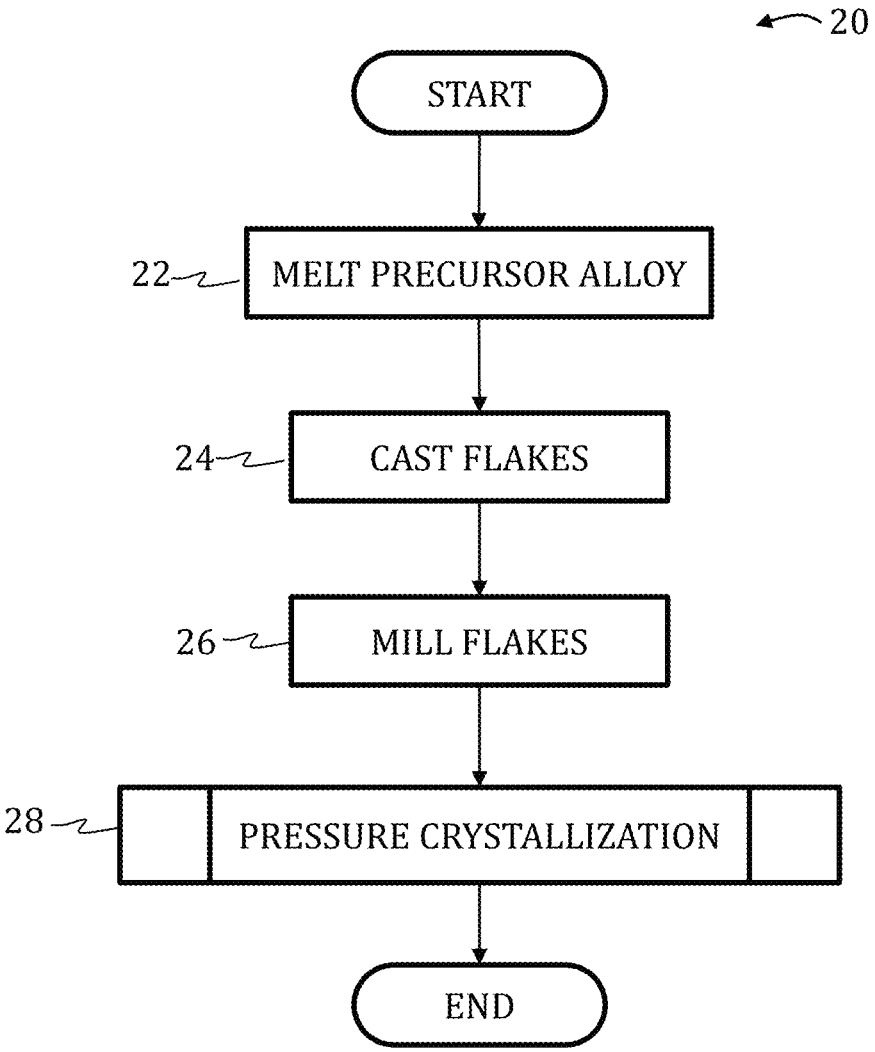
FIG. 3 is a flowchart illustrating a method of preparing an anisotropic, exchange-spring magnet according to an embodiment of the present invention.

Referring now to the FIGS., and in particular to FIG. 3, a method 20 of preparing an anisotropic, exchange-spring magnet according to an embodiment of the present invention is shown. At start, a precursor alloy rich in magnetically soft phase content (for example, α-Fe, Fe—Co, Fe—N, Co, Ni, or combinations thereof) and a hard magnetic phase (for example, Nd—Fe—B, Sm—Co, Sm—Fe—N, Fe—Pt, or Co—Pt) having nominal rare earth content (generally less than 11.76 at. %, or specifically in some embodiments ranging between 4.7 at. % and 8.2 at. %, or between 5.9 at. % and 8.2 at. %, or between 7.1 at. % and 8.2 at. %) may be melted (Block 22) (such as by arc melt) and flakes cast (Block 24) to at least a partially amorphous state in the form of flakes. Generally, any range of nominal rare earth content may be used so long as, stoichiometrically, a two-phase material results. For instance, suitable nominal rare earth content less than about 11.76 at. % for $Nd_2Fe_{14}B$, less than about 16.6 at. % for $SmCo_5$, less than about 10.5 at. % for $Sm_2Co_{17}$, less than about 9.1 at. % for $Sm_2Fe_{17}N_3$, less than about 11.76 at. % for $Pr_2Fe_{14}B$, and less than about 16.6 at. % for $PrCo_5$ may be used (similarly, for noble metal Pt: less than about 50 at. % for each, individually, of FePt and CoPt). Melting (Block 22), according to various embodiment so the present invention may comprise arc melting, induction melting, levitation melting, and powder metallurgy ("PM") and may be performed multiple times, if desired, until a homogenous alloy results. Flakes may be cast (Block 26) by melt spinning. For example, wheel speeds ranging from 5 m/s to 65 m/s with cooling rates ranging from $10^4$ K/s to $10^7$ K/s. Alternatively, casting procedures may include splat quenching, planar flow casting, or gas/water atomization with similar cooling rates.

Depending on cooling rates, casting may yield amorphous, crystalline, or overquenched flakes, wherein the latter comprises a crystalline lacking fully developed microstructure and no significant coercivity values. Fully amorphous flakes are not preferred as milling (Block 26) may be difficult, the flakes are ductile, and most of the flakes bonded to the milling media and milling jar during milling. Overquenched flakes did not present such problems.

The formed flakes may then be milled to a fine powder (Block 26). Milling may include, for example, ball milling, planetary, or other milling apparatus having enough impact energy to reduce the size of the flakes. Alternatively still, according to some embodiments of the present invention in which fully crystalline or fully amorphous flakes are used, cryomilling, or other like milling process may be used. Milling provides the benefit of remove background memory with respect to nuclei and crystal growth preference. According to one exemplary embodiment, a SPEX high energy ball mill ("HEBM") may be used. Ball milling the flakes results in an amorphization of the rare earth and the magnetically soft phase, leaving only a portion of the magnetically soft phase in a crystalline state. A ball-to-powder weight ratio ("BPR") may range from 1 to 10, although a BPR of 5 may be preferred in some embodiments.

Figure 3A:
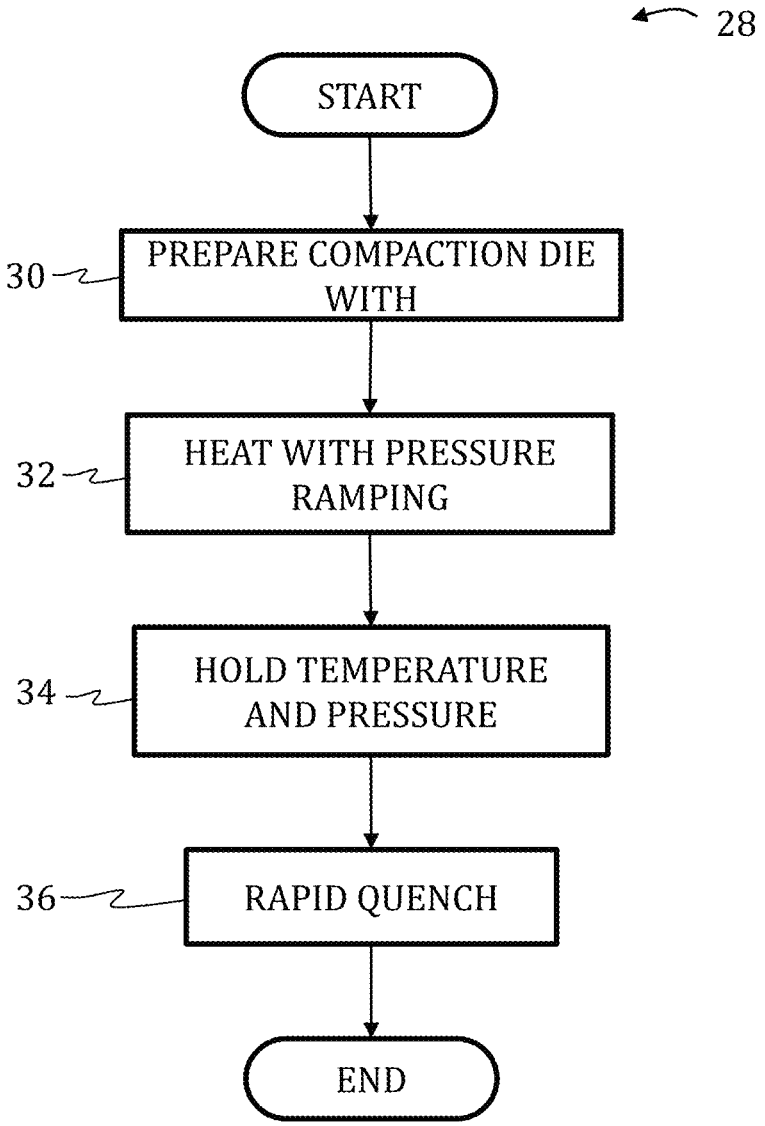
FIG. 3A is a flowchart illustrating the pressure crystallization subprocess of the method illustrated in FIG. 3 and in accordance with an embodiment of the present invention.

Once the fine powder is obtained, a pressure crystallization process (Block 28) may proceed, which is described in greater detail with reference to FIG. 3A. The pressure crystallization process may be configured to yield a finely distributed uniform microstructure with preferential growth by utilizing uniaxial stress so as to control the growth of an interface between amorphous phase and nanocrystals.

Figure 4:
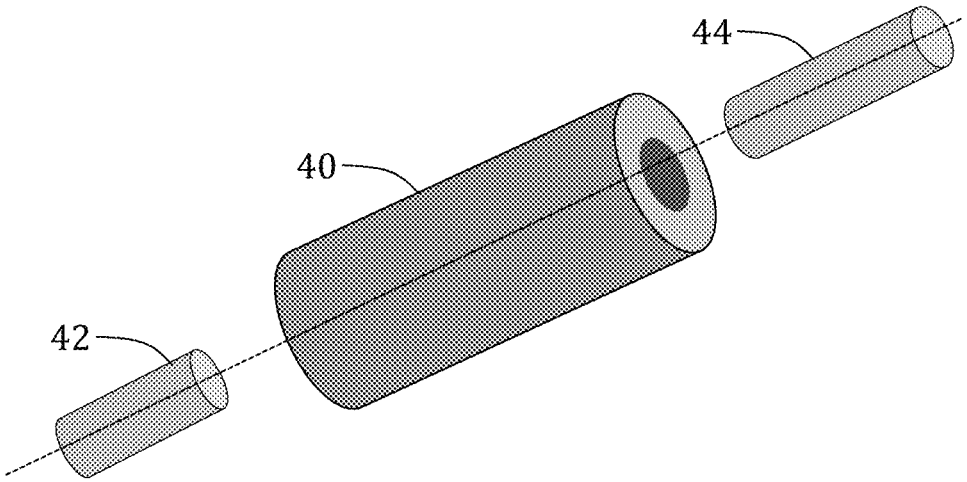
FIG. 4 is a side elevational, exploded view of an exemplary compaction die suitable for embodiments of the present invention.
Figure 5:
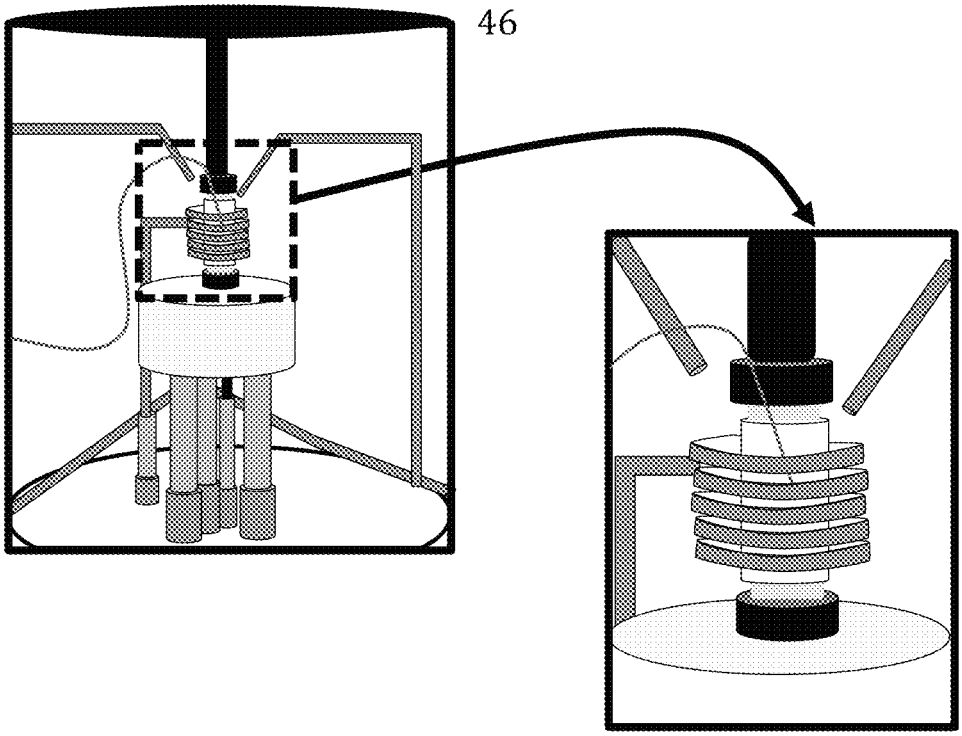
FIG. 5 is a side elevational view of an exemplary hot press suitable for use with the method of FIGS. 3 and 3A.

With reference now to FIGS. 4 and 5 as well as FIG. 3B, and at start, a compaction die (such as the tungsten carbide die 40, first and second punch 42, 44) may be positioned within a heating system 46. FIG. 5 illustrates a portion of an exemplary inductively heated hot press that may be used according to some embodiments; however, because of the slower diffusion kinetics observed under pressure, other heating systems, such as a resistively heated consolidation system, may alternatively be used. Generally, with reference to the illustrated embodiment of FIG. 5, the hot press may be configured to apply pressures of up to 1 GPa; however, other hot presses may be used so long as pressures of 0.5 GPa or more may be obtained (or, more particularly, ranging from 0.5 GPa to about 3 GPa). The fine powder within the compaction die are prepared (Block 30) and heated to a crystallization temperature for the particular alloy with a simultaneous ramping (for example, about 100 K/min; however, the ramping may be heating system and sample size dependent) of temperature to a crystallization pressure (for example, 1 GPa at, for example, about 200 MPa/min) over a pressurizing time (typically ranging from 3 min to 5 min) (Block 32). Crystallization temperatures may be determined in a manner that would be understood by those of ordinary skill in the art, for example, by a Differential Scanning Calorimeter ("DSC"). The fine powder and compaction die are held at the crystallization temperature and crystallization pressure for a hold time, which may range vary and depends, in part, on the crystallization pressure (Block 34). After the holding time, the compaction die and powder are rapidly gas quench to a temperature below 200° C. in less than 1 min.

Anisotropic alloys, produced according embodiments of the present invention as described herein, provide several benefits over conventional methods. Alloys resulting from embodiments of the present invention is the annealing/crystallization times necessary for optimum properties. Conventional, overquenched flakes need approximately 3 min annealing to arrive at optimum grain sizes; the alloys produced according to methods and embodiments described herein are obtained after 20 min. While not wishing to be bound by theory, it is believed that the former, conventional alloys comprise nuclei such that annealing drives grain growth alone. By utilizing quasiamorphous precursors, as described herein, nucleation must occur before grain growth may begin. Accordingly, nucleation with limited grain growth takes place within the first few minutes (for example, 5 min) of the pressure crystallization, annealing process. Grain growth thus occurs over the remaining processing time (for example 15 min). Such slower diffusion kinetics, under pressures, make it possible to use resistively heated consolidation systems for hot pressing.

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

Example 1—Preparation and Crystallization

Iron rich Nd—Fe—B alloys with nominal Nd contents (between 8.2 at. % and 5.9 at. %) were melt-spun to a partially amorphous state in the form of flakes. The flakes were ball milled to a fine powder form using a SPEX high energy ball mill ("HEBM"), resulting in an amorphization of Nd and B, leaving only a portion of the α-Fe in a crystalline state. A ball-to-powder weight ratio ("BPR") of 5 was employed for the milling studies. Crystallization temperatures were determined by a Differential Scanning Calorimeter ("DSC") (Perkin Elmer, Inc., Waltham, Mass.). High pressure crystallization studies were carried out using an inductively heated hot press under pressures as high as 1 GPa. Thermomagnetic, M(T), measurements were carried out using a Vibrating Sample Magnetometer ("VSM") (Lake Shore Cryotronics, Inc., Westerville, Ohio) equipped with a high temperature furnace. A diffractometer (Bruker Corp., Billerica, Mass.) was used for structural characterizations. The compacted samples were examined in a CM200 Transmission Electron Microscope ("TEM") (Koninklijke Philips N.V., Amsterdam).

Example 2—Cast Flakes

Figure 6:
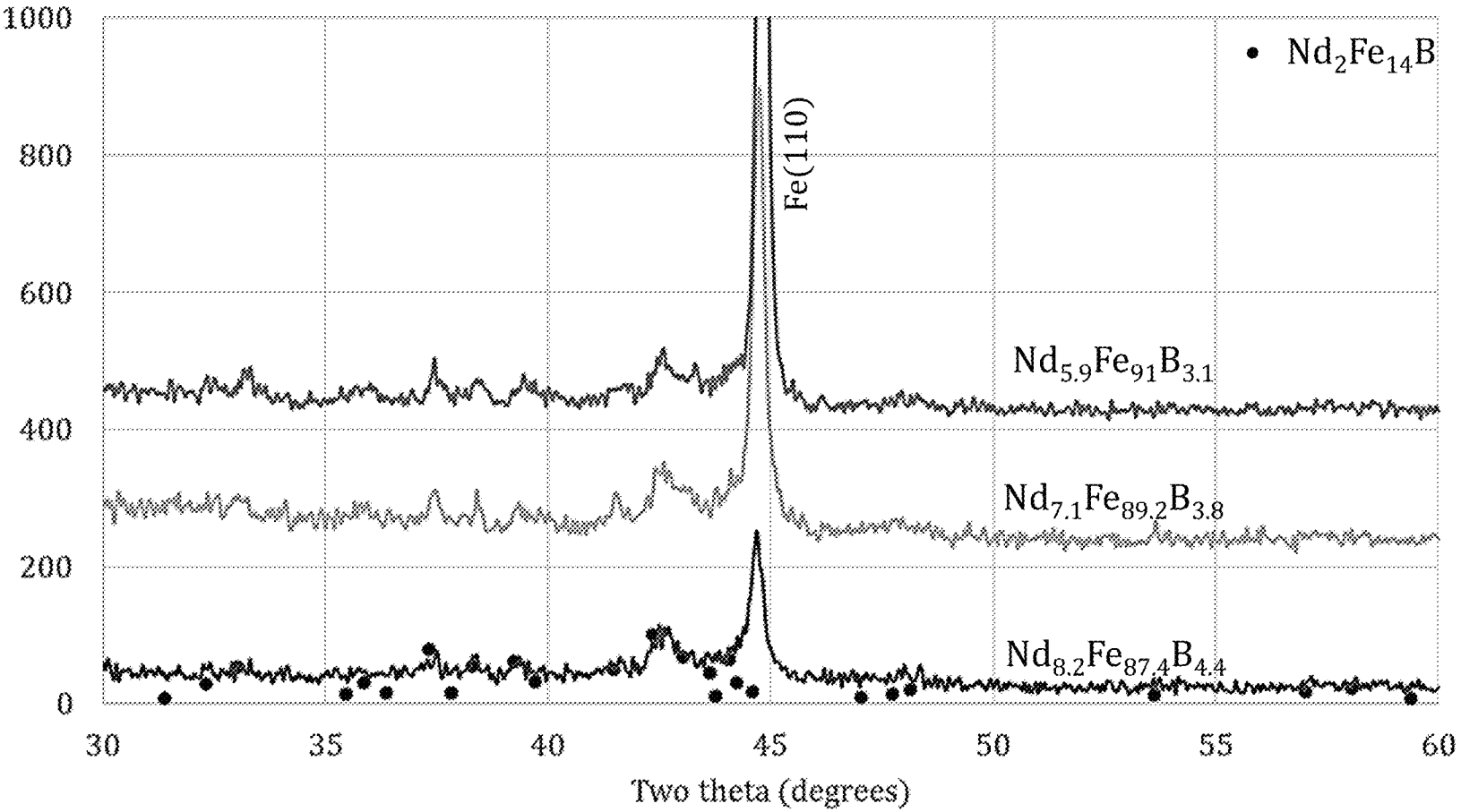
FIG. 6 is a graphical representation of X-Ray Diffraction plots of melt spun materials of overquenched flakes prepared by methods in accordance with embodiments of the present invention.

Melt spinning yielded overquenched flakes with no significant coercivity values. FIG. 6 illustrates X-Ray Diffraction ("XRD") plots of these melt spun materials. All three compositions were of $Nd_2Fe_{14}B$ and α-Fe in varying ratios, i.e., the higher the Nd content the higher the $Nd_2Fe_{14}B$ fraction. No intermediate phases were detected other than the two main phases.

Figure 7:
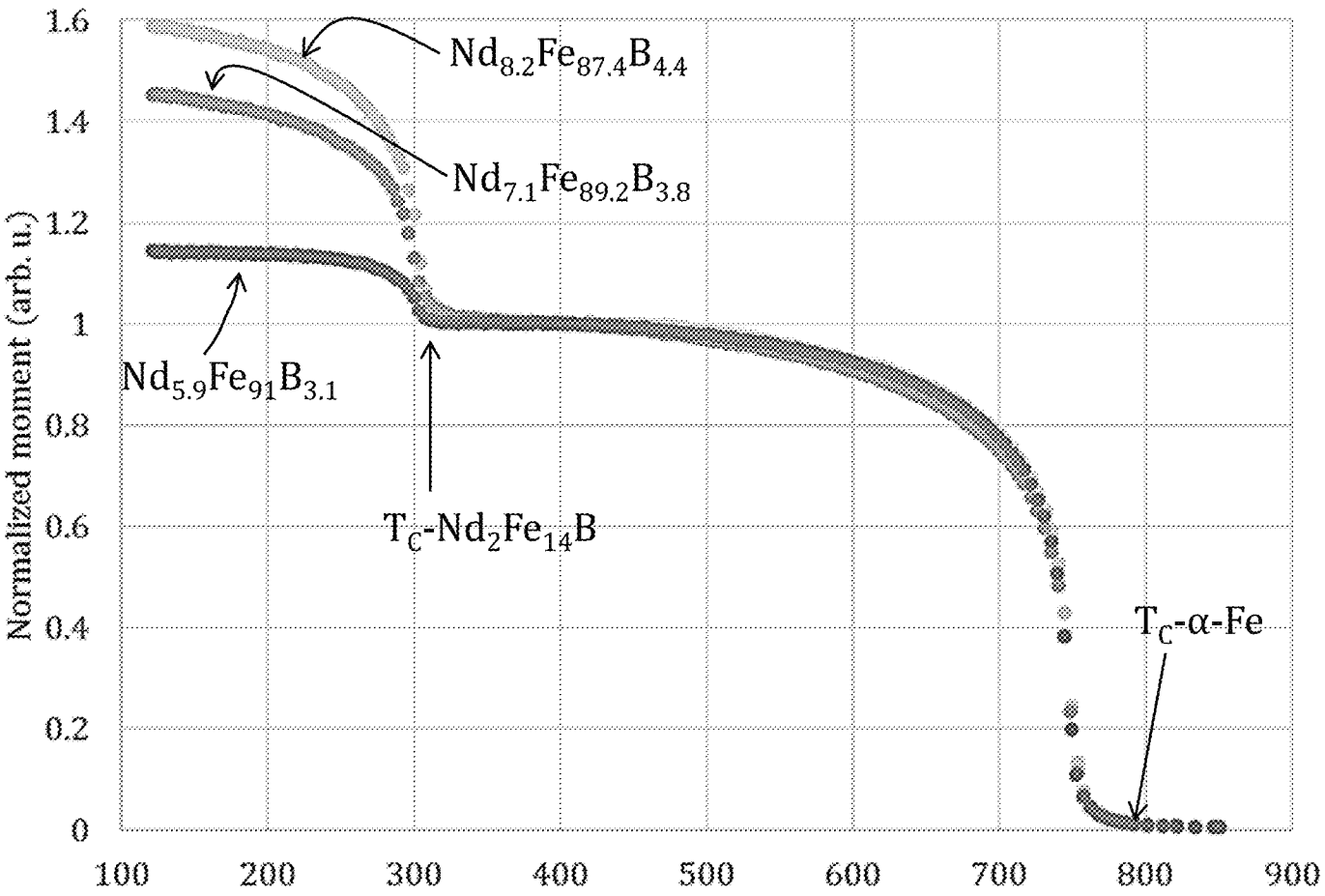
FIG. 7 is a graphical representation of thermomagnetic measurements confirming the presence of $Nd_2Fe_{14}B$ and $\alpha$-Fe in the prepared melt spun materials.

The presence of the $Nd_2Fe_{14}B$ and α-Fe was confirmed by thermomagnetic measurements, which are graphically illustrated in FIG. 7.

VSM is more sensitivity to the detection of minor ferromagnetic phases than thermomagnetic measurements. The results of VSM measurements indicated fully crystallized cast flakes having only two phases.

Volume fraction ratios were estimated from thermomagnetic measurements and revealed iron vol. % of approximately 30.8, 40.6, and 49.9 for alloys with Nd vol. % contents of 8.2, 7.1, and 5.9, respectively.

Figure 8:
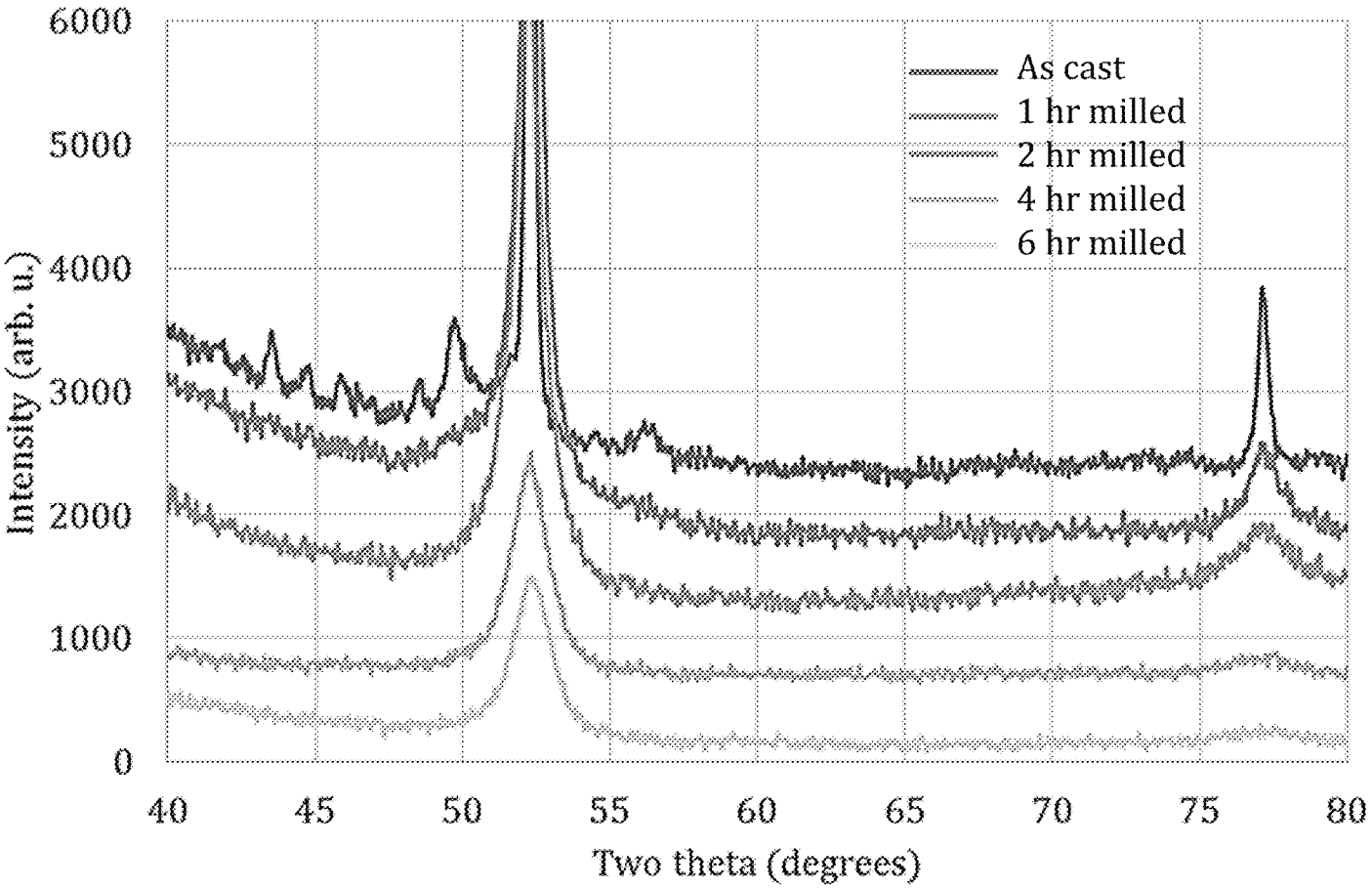
FIG. 8 is a graphical representation of $Nd_{5.9}Fe_{91}B_{3.1}$ alloy, milled with ball-to-powder weight ratio of 4 for 1 hr, 2 hr, 4, hr, and 6 hr.

FIG. 8 is a graphical representation of the $Nd_{5.9}Fe_{91}B_{3.1}$ alloy, milled with ball-to-powder weight ratio of 4 for 1 hr, 2 hr, 4, hr, and 6 hr. The illustrated data demonstrates a minimum of about two hours for milling to transform the $Nd_2Fe_{14}B$ into the amorphous state was identified by periodically monitoring crystallinity during high energy ball milling experiments. The crystallization temperature of $Nd_2Fe_{14}B$ in ball milled samples was determined to be 560° C. by DSC measurement.

Example 3—Pressure Crystallization

Pressure crystallization was carried out using tungsten carbide compaction dies. Typical runs consisted of (1) about 5 min of heating to 560° C. with simultaneous ramping of pressure, (2) a predetermined holding time at 560° C. and the pressure 1 GPa, and (3) a gas quench to a temperature below 200° C. in less than 1 min.

Figure 9:
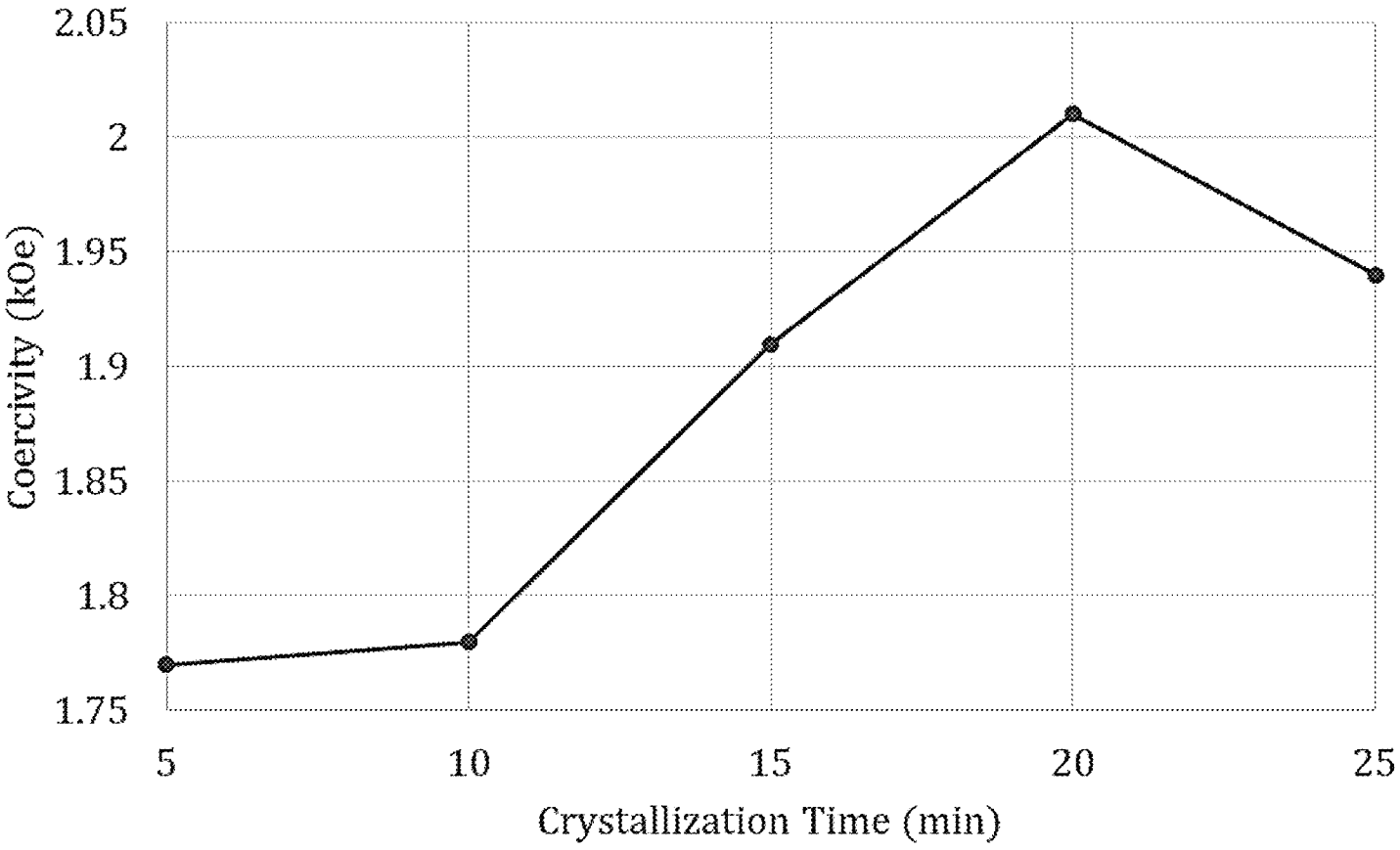
FIG. 9 graphical representation illustrating the evolution of coercivity as a function of crystallization time for $Nd_{5.9}Fe_{91}B_{3.1}$ at 560° C. and 750 MPa.

FIG. 9 is a graphical representation illustrating the evolution of coercivity as a function of crystallization time for $Nd_{5.9}Fe_{91}B_{3.1}$ at 560° C. and 750 MPa. Particular results for coercivity are provided in Table 1, below.

Figure 10:
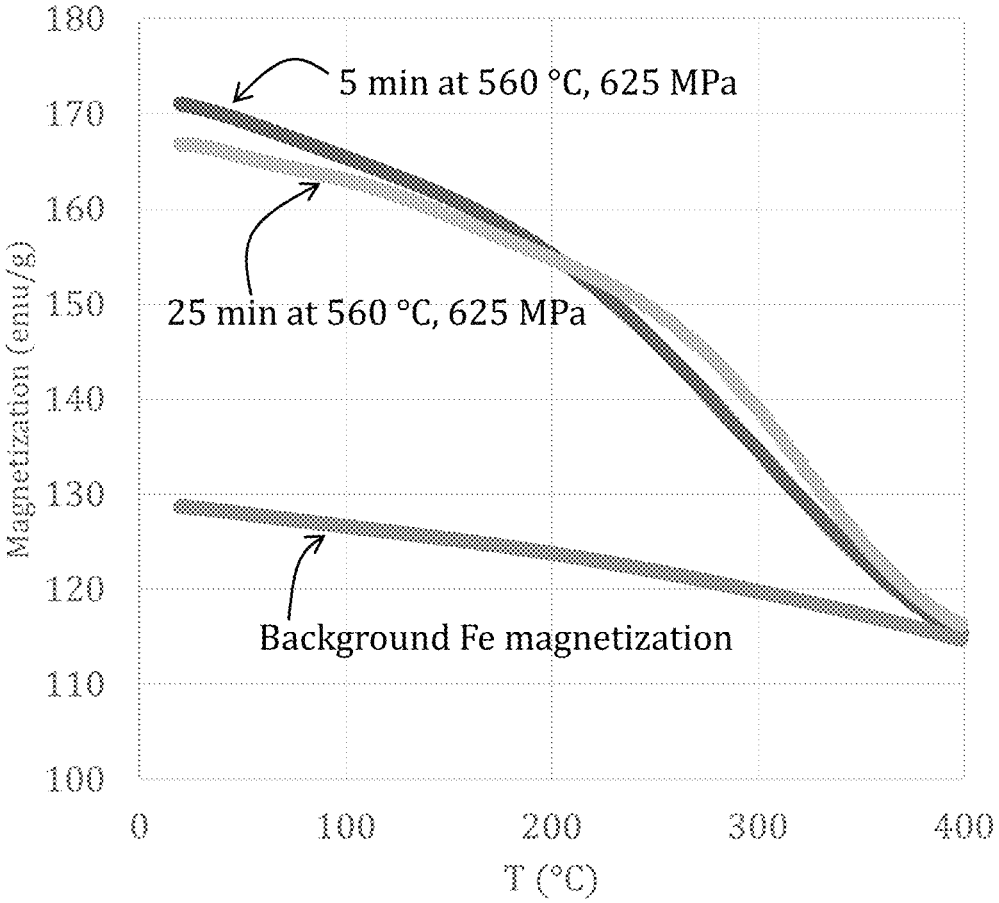
FIG. 10 graphically illustrates thermomagnetic curves for 5 min and 20 min crystallized bulk samples at an external field of 1.8 kOe.

FIG. 10 graphically illustrates thermomagnetic curves for 5 min and 20 min crystallized bulk samples at an external field of 1.8 kOe. Experimentally determined background Fe magnetization for each measurement is shown for quantifying the volume ratios of $Nd_2Fe_{14}B$ and α-Fe from saturation magnetization, $M_s$, values, which are specifically noted in Table 1, below. An approximately 2% difference in $M_s$ values of 5 min and 20 min crystallized bulk samples indicates that nearly all crystallization occurs within the first 5 min. The increasing coercivity with increased crystallization time (FIG. 9) is mainly due to grain growth.

TABLE 1

| ALLOY | CRYSTALLIZATION PRESSURE (GPa) | $H_c$ (kOe) | $M_s$ @ 18 kOe (emu/g) |
|---|---|---|---|
| $Nd_{8.2}Fe_{87.4}B_{4.4}$ | 1 | 2.58 | 160.27 |
| $Nd_{7.1}Fe_{89.2}B_{3.4}$ | 0.625 | 2.01 | 169.76 |
| $Nd_{5.9}Fe_{91}B_{3.1}$ | 1 | 1.66 | 178.63 |

Samples crystallized up to 20 min were characteristic of a fully exchange coupled system. Beyond the crystallization time of 20 min, loops became constricted, which indicates improper coupling due to grain overgrowth.

Example 4—Comparison with Conventional Alloys

For conventional isotropic alloys, such as those described by A. INOUE et al., "Hard magnetic properties of Nd—Fe—B alloys containing intergranular amorphous phase," IEEE Trans. Magn., Vol. 31 (1995) 3626-3628 and Y. Q. WU et al., "Microstructural characterization of an α-Fe/$Nd_2Fe_{14}B_1$ nanocomposite with a remaining amorphous phase," J. Appl. Phys., Vol. 87 (2000) 8658-8665, an annealing time in overquenched flakes of approximately 3 min is usually sufficient to arrive at optimum grain sizes. Similar grain size ranges for alloys prepared using methods according to embodiments of the present invention described herein are obtained after 20 min.

These conventional alloys are already populated with nuclei such that annealing provides a driving force only for the grain growth. For alloys prepared using methods according to embodiments of the present invention described herein with quasiamorphous precursors, initiation of nucleation occurs before grain growth. For example, it is discernable from FIG. 10 that nucleation and some grain growth takes place within the first 5 min of pressure crystallization; the next 15 min are required for grain growth. This is a clear indication of slower, diffusion kinetics under pressure.

Figure 11A:
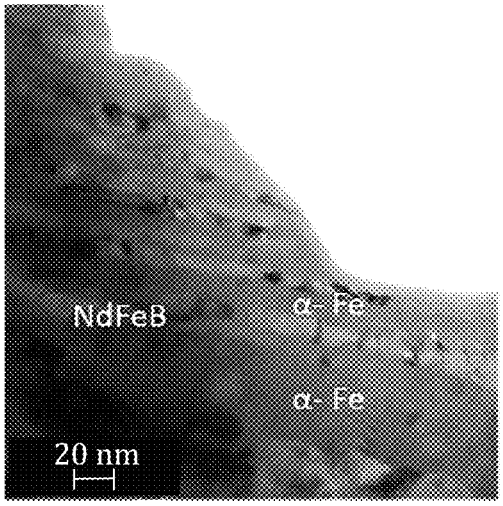
FIGS. 11A-11B are transmission electron microscope bright field images of $Nd_{5.9}Fe_{91}B_{3.1}$ material crystalized at 560° C. for 5 min.
Figure 11B:
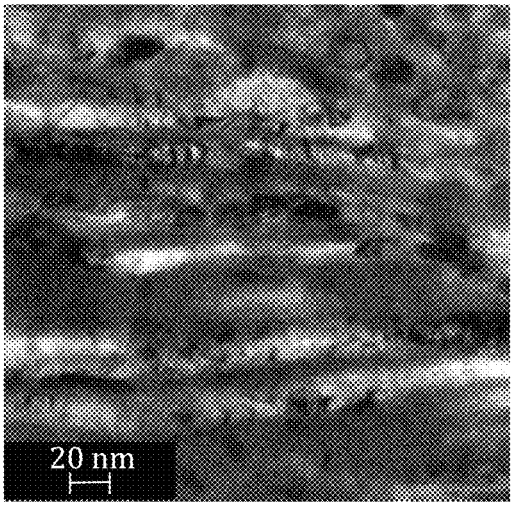
Figure 11C:
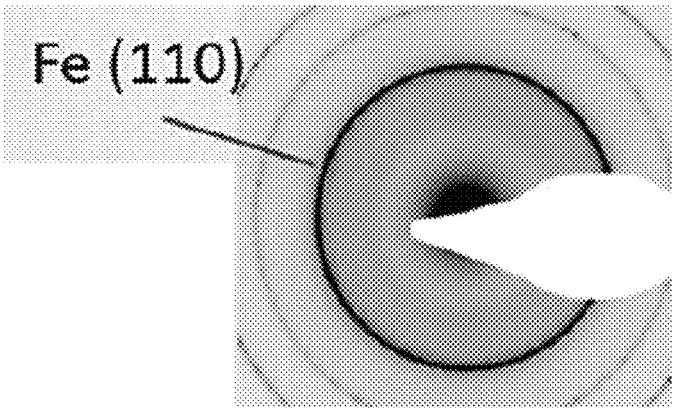
FIG. 11C is a selected area electron diffraction pattern associated with the TEM images of FIG. 11A.

FIGS. 11A and 11B are transmission electron microscope ("TEM") bright field images of $Nd_{5.9}Fe_{91}B_{3.1}$ material crystalized at 560° C. for 5 min. FIG. 11C is the selected area electron diffraction pattern associated with the TEM images of FIG. 11A.

Figure 12A:
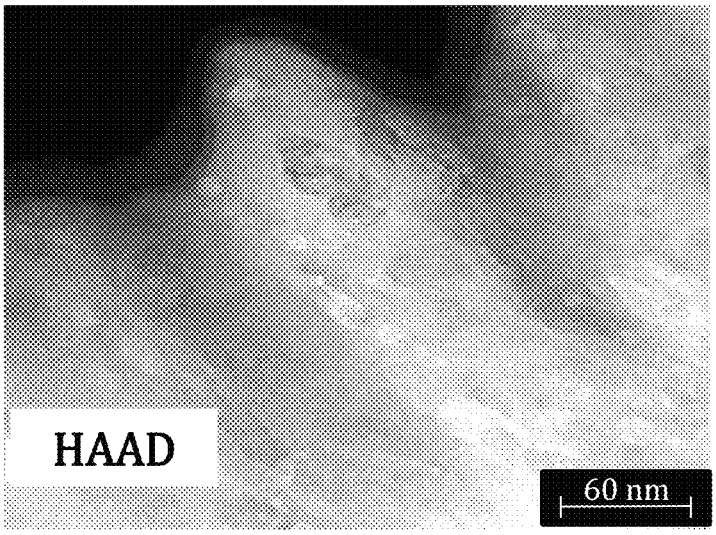
FIGS. 12A-12C are elemental mapping images of $Nd_{5.9}Fe_{91}B_{3.1}$ material crystallized at 560° C. for 18 min.
Figure 12B:
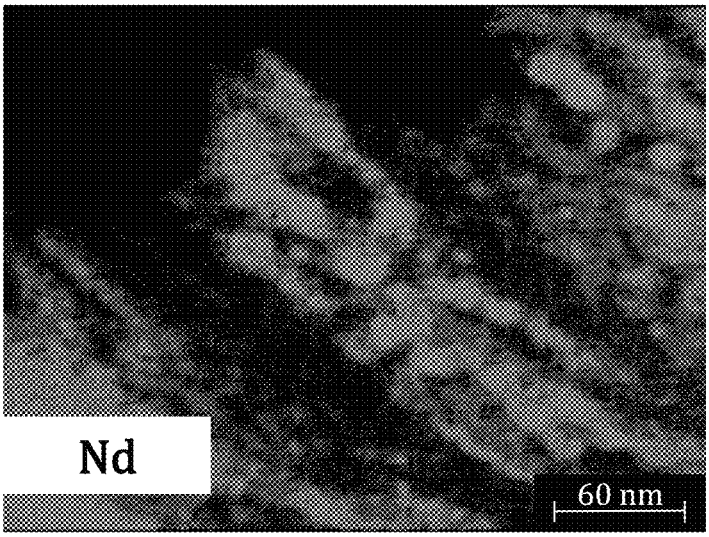
Figure 12C:
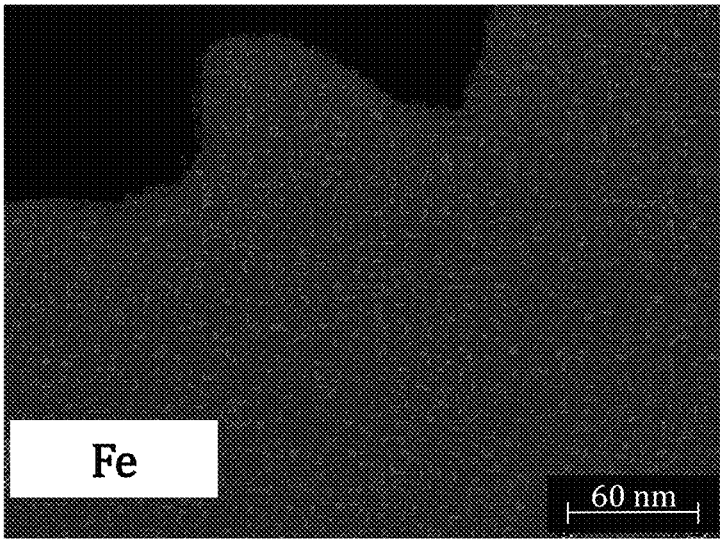

FIGS. 12A-12C are elemental mapping images of $Nd_{5.9}Fe_{91}B_{3.1}$ material crystallized at 560° C. for 18 min.

Example 5—Crystallographic Alignment

Figure 13:
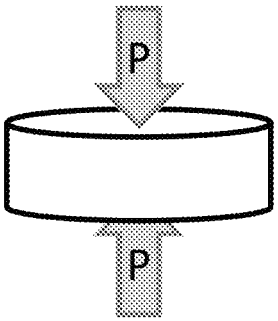
FIG. 13 is a schematic illustration of texture formation.
Figure 14:
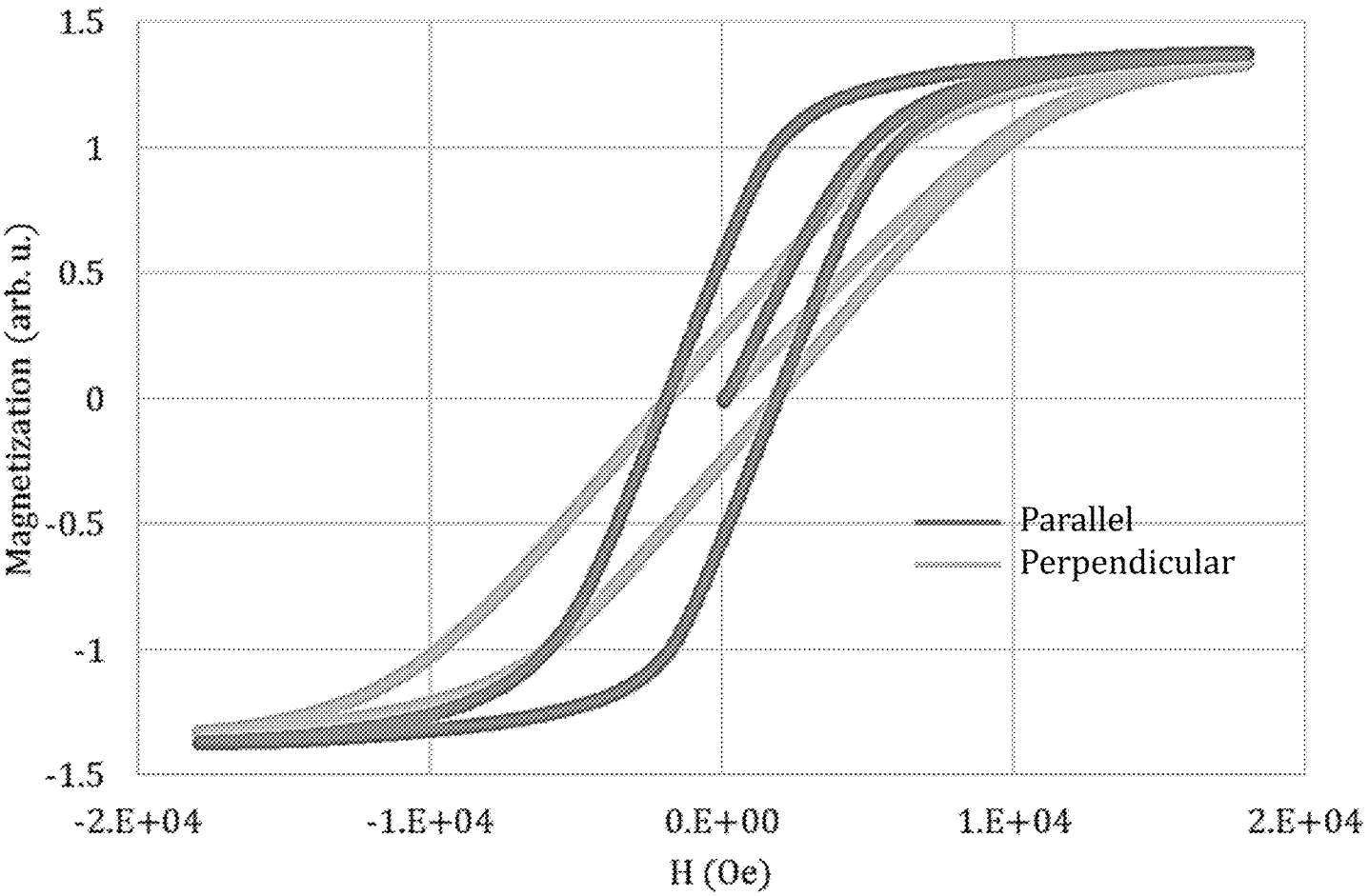
FIG. 14 is a graphical representation of anisotropic behavior in MH curves taken parallel and perpendicular to the load direction.
Figure 15:
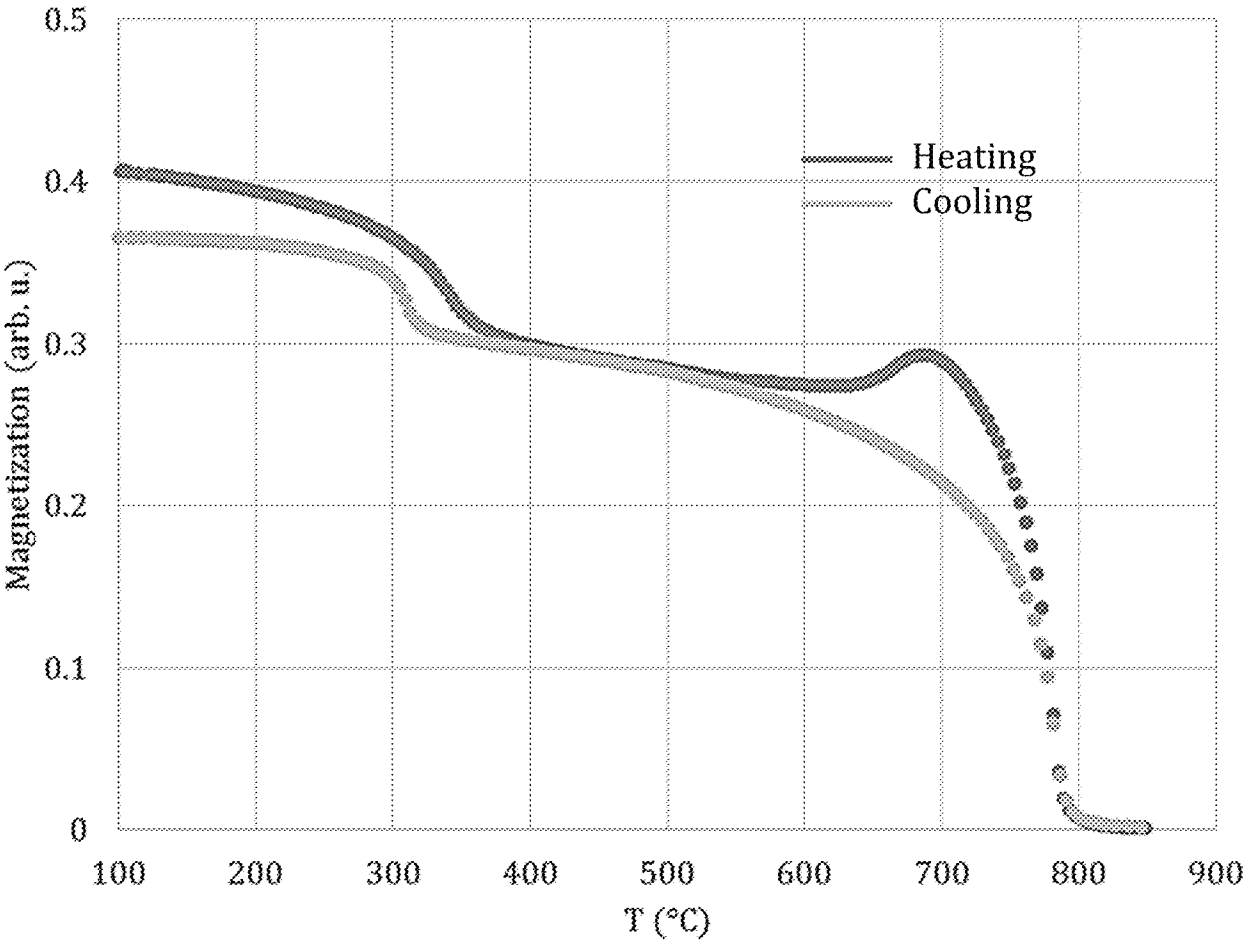
FIG. 15 is a graphical representation of heating and cooling effects on magnetization FIGS. 16A and 16B graphically illustrate a comparison of $\alpha$-Fe I(110)/I(200) intensity ratios did not indicate a presence of texture for iron.

Growth of a crystalline interface in an amorphous matrix occurs along crystallographic directions that minimize strain energy. The idea of texture formation under pressure (schematically illustrated in FIG. 13) relies on modification of the strain energies at the growth interface by application of an external stress and promoting preferential growth along certain crystallographic directions. Distinct microstructures obtained by TEM images in which alternating layers of α-Fe and $Nd_2Fe_{14}B$ are realized by pressure crystallization. Elemental mapping by STEM (Scanning Transmission Electron Microscope) reveals two distinct regions and length scales in which α-Fe and $Nd_2Fe_{14}B$ phases are intermixed. On a larger scale, alternating layers of α-Fe and $Nd_2Fe_{14}B$ are still visible. Within the $Nd_2Fe_{14}B$ bands, a finer scale distribution of α-Fe also exists. These layered structure translates to an anisotropic behavior in MH curves taken parallel and perpendicular to the load direction (data being graphically shown in FIG. 14). Heating and cooling effects on magnetization are graphically illustrated in FIG. 15. FIGS. 14 and 15 are not corrected for demagnetization fields.

Table 2, below, lists grain sizes of 5.9 at. % and 8.2 at. % Nd that were pressure crystallized under 1 GPa pressure for 20 minutes. A Scherrer analysis of the XRD patterns taken on surfaces parallel and perpendicular to a load direction showed different grain sizes in different directions. For samples containing 8.2 at. % Nd, average grain size observed in the parallel direction were 0.5 times as much as average grain size observed in the perpendicular direction. For the 8.2 at. % Nd sample, the difference in grain size was about 0.75%. Despite its layered morphology, observed differences in grain sizes were not as pronounced in α-Fe. From TEM images, such diminished difference in observed grain size of the α-Fe was likely due the α-Fe layers comprising mostly equiaxed subgrains.

Figure 16A:
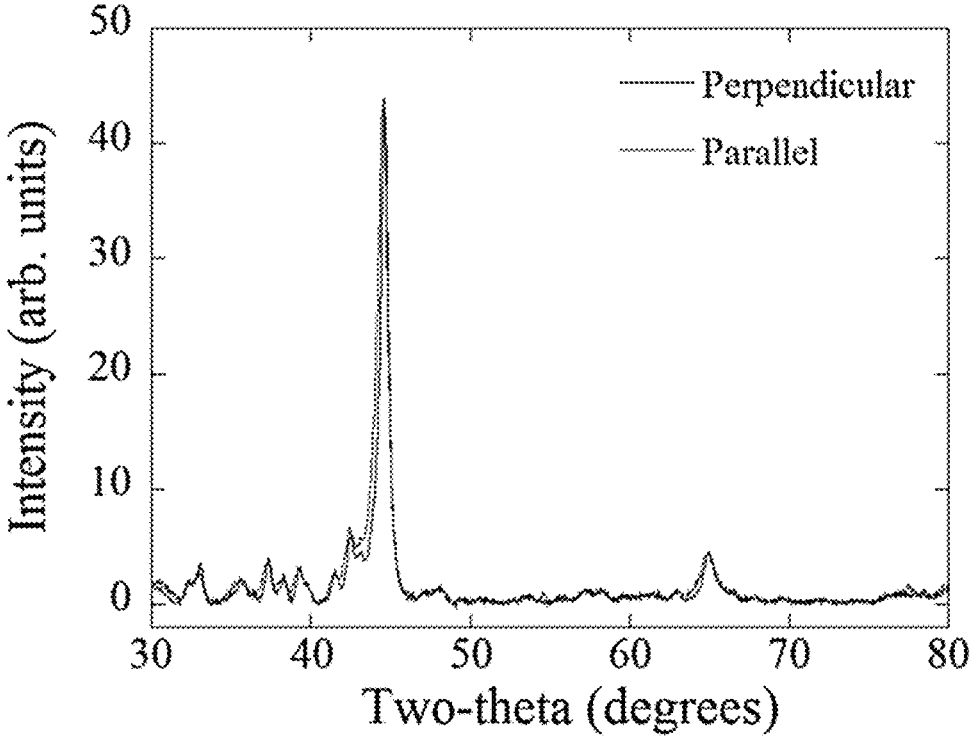
Figure 16B:
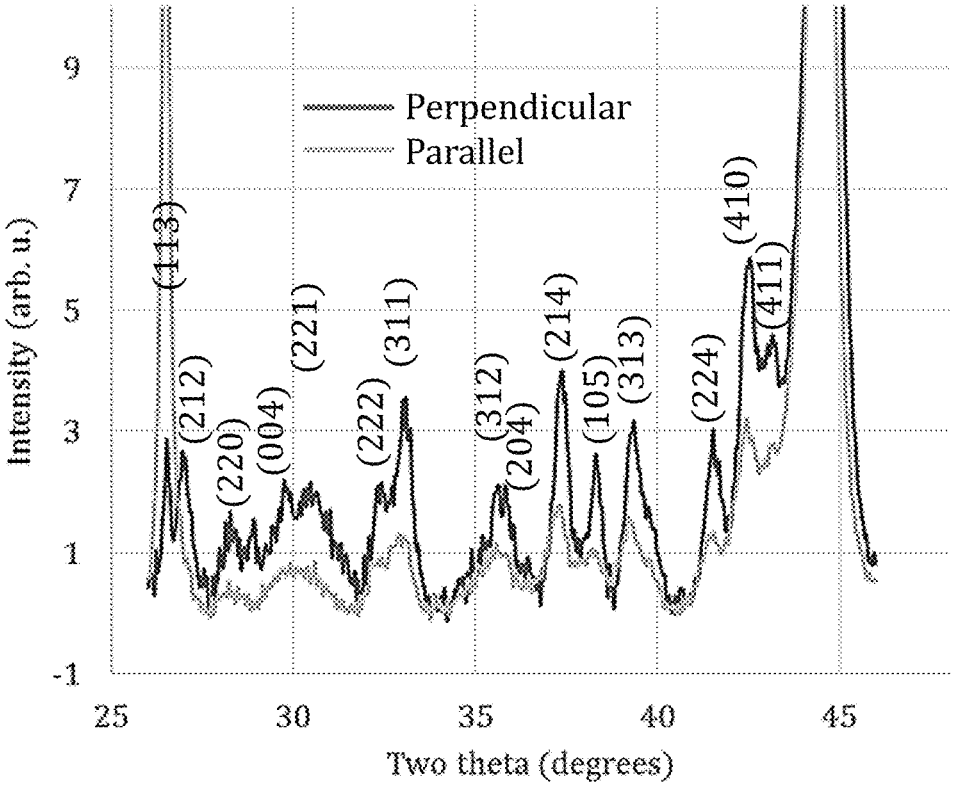

Comparison of the α-Fe I(110)/I(200) intensity ratios did not indicate a presence of texture for iron. However, a stronger (113) and a diminished (220) reflection of $Nd_2Fe_{14}B$ (FIGS. 16A and 16B) for loading in the parallel direction strongly suggests that a presence of external stress does promote preferential growth.

A similar crystalline alignment occurs in the $Nd_2Fe_{14}B$ system during die-upsetting process. In this process, over-quenched Nd—Fe—B is first hot compacted to a near full density during which full crystallization takes place. During the die-upsetting step, the fully dense compact is hot deformed uniaxially to the half of its original height. During the hot deformation, grains grow by an order of magnitude into platelet shaped grains while the "c" axis is aligned parallel to the stress direction. This alignment is explained by preferential growth of grains whose "c" axis coincides with the load direction at the expense of grains whose "c" axis do not. It is highly likely that a similar preferential growth mechanism is responsible for the pressure crystallized samples.

Once the first $Nd_2Fe_{14}B$ nuclei appear, in this case most likely by heterogeneous nucleation, the planes whose surface energy is lowered by the external load grow faster than the others. Die-upsetting requires presence of a Nd-rich intergranular phase and final grain sizes are on the order of several hundred nanometers. Grain sizes of the pressure crystallized samples on the other hand can be tailored to the optimal values to obtain the highest coercivities.

The obtained coercivities of 1.98 kOe and 2.5 kOe for the samples with 5.9 at. % and 8.2 at. % Nd, respectively, were comparable to the reported coercivities of isotropic alloys with similar Nd content. A. INOUE et al. (supra) reported a coercivity of 3.01 kOe for a $Nd_8Fe_{88}B_4$ alloy while Y. LIU et al., "Development of crystal texture in Hd-lean amorphous $Nd_9Fe_{85}B_6$ under hot deformation," Appl. Phys. Lett., Vol. 94 (2009) 172502, reported coercivities of about 3.2 kOe for a $Nd_8Fe_{85}B_6$ alloy. Y. Q. WU et al. (supra) reported a coercivity value of 3.6 kOe for a Co containing $Nd_8Fe_{78}Co_8B_6$ alloy with higher boron content than the alloys studied in this work.

As presented herein, methods of preparing bulk permanent magnetic nanocompositions having decreased rare earth metal composition are described. For example, conventionally the amount of Nd in a stoichiometric $Nd_2Fe_{14}B$ magnet is 11.76 at. %. As provided herein, a nanocomposite having 5.9 at. % content Nd exhibited permanent magnetic properties.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A method of preparing an anisotropic permanent magnet nanocomposite, the method comprising:

melting a precursor alloy having a hard magnetic phase and a magnetically soft phase, the hard magnetic phase comprising less than a stoichiometric amount of a rare earth metal or a noble metal;

casting the melted precursor alloy into flakes;

milling the casted flakes into a powder; and pressure crystalizing the powder by:

pressurizing and heating the powder at a crystallization pressure ranging from about 0.5 GPa to about 3 GPa and at a crystallization temperature over a pressurizing time, wherein the powder is pressurized at a rate of about 200 MPa/min;

holding the powder at the crystallization temperature and the crystallization pressure over a hold time to promote crystal growth; and rapidly quenching the crystal growth to a temperature less than about 200° C. in less than about a minute.

2. The method of claim 1, wherein the hard magnetic phase comprises:

Nd—Fe—B, Sm—Co, Sm—Fe—N, Fe—Pt, or Co—Pt.

3. The method of claim 2, wherein the permanent magnet nanocomposite is $SmCo_5$, the rare earth metal is Sm, and the stoichiometric amount is about 16.6 at. %.

4. The method of claim 2, wherein the permanent magnet nanocomposite is $Sm_2Co_{17}$, the rare earth metal is Sm, and the stoichiometric amount is about 10.5 at. %.

5. The method of claim 2, wherein the permanent magnet nanocomposite is $Sm_2Fe_{17}N_3$, the rare earth metal is Sm, and the stoichiometric amount is about 9.1 at. %.

6. The method of claim 2, wherein the permanent magnet nanocomposite is FePt or CoPt, the noble metal is Pt or Co, and the stoichiometric amount is about 50 at. %.

7. The method of claim 2, wherein the permanent magnet nanocomposite is $Pr_2Fe_{14}B$, the rare earth metal is Pr, and the stoichiometric amount is about 11.76 at. %.

TABLE 2

| ALLOY | CRYSTALLIZATION PRESSURE (GPa) | $D_{av}$NdFeB (nm) Parallel | $D_{av}$-NdFeB (nm) Perpendicular | $D_{av}$ α-Fe (nm) Parallel | $D_{av}$ α-Fe (nm) Perpendicular |
|---|---|---|---|---|---|
| $Nd_{8.2}Fe_{87.4}B_{4.4}$ | 1 | 10.9 | 21.3 | 13.7 | 18.2 |
| $Nd_{8.2}Fe_{87.4}B_{4.4}$ | 0.5 | 11.7 | 14.1 | 14.1 | 13.5 |
| $Nd_{8.2}Fe_{87.4}B_{4.4}$ | 0 | 28.9 | 28.9 | 68.9 | 68.9 |
| $Nd_{5.9}Fe_{91}B_{3.1}$ | 1 | 11.7 | 15.2 | 19.5 | 18 |

8. The method of claim 2, wherein the permanent magnet nanocomposite is $Pr_2Co_5$, the rare earth metal is Pr, and the stoichiometric amount is about 16.6 at. %.

9. The method of claim 2, wherein the permanent magnet nanocomposite is $Nd_2Fe_{14}B$, the rare earth metal is Nd, and the stoichiometric amount is about 11.76 at. %.

10. The method of claim 1, wherein the magnetically soft phase comprises:

α-Fe, Fe—Co, Fe—N, Co, Ni, or combinations thereof.

11. The method of claim 1, wherein melting the precursor alloy further comprises:

arc melting, induction melting, levitation melting, or powder metallurgy processing.

12. The method of claim 1, wherein casting the melted precursor alloy further comprises:

melt spinning, splat quenching, or planar flow casting.

13. The method of claim 1, wherein the flakes yielded from casting the melted precursor alloy are amorphous or crystalline.

14. The method of claim 13, wherein milling the casted flakes further comprises cryomilling.

15. The method of claim 1, wherein heating the powder occurs at a rate of about 100 K/min.

16. The method of claim 1, wherein the pressurizing time is less than 5 min.

17. The method of claim 1, wherein the pressurizing time is less than 3 min.

18. The method of claim 1, wherein the hold time is less than 20 min.

19. The method of claim 1, wherein rapidly quenching includes using a gas quench.

20. The method of claim 1, wherein pressurizing and crystalizing the powder comprises inductively heating or resistively heating.

21. The method of claim 1, wherein pressurizing and crystalizing are configured to initiate nucleation.

* * * * *